United States Patent [19]

Wiebe

[11] 4,164,725

[45] Aug. 14, 1979

[54] THREE-PIECE SOLDERLESS PLUG-IN ELECTRICALLY CONDUCTING COMPONENT

[76] Inventor: Gerald L. Wiebe, 18 W. 077 Williamsburg La., Villa Park, Ill. 60181

[21] Appl. No.: 820,555

[22] Filed: Aug. 1, 1977

[51] Int. Cl.[2] ..... H01H 85/02

[52] U.S. Cl. ..... 337/198; 337/252; 339/19; 339/258 R; 29/623

[58] Field of Search ..... 337/198, 251, 252, 262, 337/253, 264, 260, 261, 214, 215, 236; 29/619, 621, 623; 338/273, 274, 275, 329; 339/19, 147 R, 258 R, 258 P

[56] References Cited

U.S. PATENT DOCUMENTS 3,493,915 2/1970 Cox ..... 339/19 X

FOREIGN PATENT DOCUMENTS 2337326 2/1975 Fed. Rep. of Germany ..... 339/258 R
2506796 9/1975 Fed. Rep. of Germany ..... 339/258 R

*Primary Examiner*—George Harris
*Attorney, Agent, or Firm*—Dressler, Goldsmith, Clement, Gordon & Shore, Ltd.

[57] ABSTRACT

A three-piece solderless plug-in electrically conducting component is provided for mounting in an electrical connector. An elongate conducting element is transversely disposed across two spaced-apart generally parallel blades and is secured at each of its ends to a spring clip near the end of each blade. In the preferred embodiment of the present invention, the component functions as a fuse wherein the elongate conducting element is a generally cylindrical fuse wire and wherein a solid unitary body of electrically insulating material encapsulates the fuse wire and spring clip of each of the blades with the external surfaces of the fuse wire and blade spring clip portions being in intimate contact with the encapsulating material. The spring clip has a pair of spaced-apart rear bearing members and a flexibly hinged front bearing tongue between the rear bearing members. Each of the rear bearing members has a cradle with a substantially V-shaped cross section for receiving a portion of the fuse wire in self-aligning, vibration resistant, clamping engagement and for accommodating fuse wires of varying diameter.

The fuse of the present invention is preferably formed by providing generally rectangular blades in spaced-apart parallel relationship, bending the front bearing tongue away from the rear bearing members on each blade to provide an opening, inserting the fuse wire through the opening into the cradles of the rear bearing members, releasing the front bearing tongue on each blade to clamp the fuse wire in the cradles, and encapsulating the assembly with a transparent thermoplastic material except for the ends of the blades opposite the fuse wire which are left projecting from the thermoplastic material for being received in female pressure clip connectors.

33 Claims, 12 Drawing Figures

THREE-PIECE SOLDERLESS PLUG-IN ELECTRICALLY CONDUCTING COMPONENT

BACKGROUND OF THE INVENTION

The present invention relates in general to electrically conducting components, and more particularly to the type of components which may be plugged in to female pressure clip connectors of the type which are commonly provided in elongate blocks of insulating material. The preferred embodiment of the present invention relates more specifically to a miniature size fuse for use in protecting electrical circuits, and especially for use in protecting electrically operated components in automotive vehicles.

The inventor of the present invention has developed an encapsulated type fuse which is disclosed in U.S. Pat. No. 3,914,863 and U.S. Pat. No. 3,832,664. The fuse disclosed in those patents is not a plug-in type and does not have terminal-forming blades perpendicular to the fuse wire and projecting from the fuse body as is typical of such plug-in fuses. Further, the fuse disclosed in those patents has a cylindrical shape with cylindrical end caps in electrical contact with the fuse wire which is coiled or bent on each end of the fuse. The end caps are held against the bent ends of the fuse wire at each end of the fuse body and the end caps are mechanically secured to the fuse body.

The above-described fuse, which functions well for its intended purpose, cannot be used in plug-in type fuse receiving blocks and requires a number of manufacturing steps to bend the fuse wire ends and apply the end caps. It would be desirable to provide a relatively simple encapsulated, plug-in type fuse which does not require the additional steps of bending of the fuse wire ends and the securing of end caps thereto.

Plug-in fuses have been developed today for use in automotive and other circuits and have a compact, substantially rectangular or square shape about ¾ inch on each side with a width of under ¼ inch. Such fuses have a fusible link surrounded by an insulating housing and have terminal-forming blade portions projecting from the housing. The blades and fusible link are made of metal and may be three separate pieces connected together or may be a single stamped piece of metal. For purposes of further discussion, the term "fuse element" will be used to mean an electrically conducting structure (commonly metal), the major portion of which is contained within the insulating housing or fuse body. The fuse element typically consists of (1) two conductor terminals (such as blades or other structures which commonly extend from the housing) and (2) one fusible link connecting the two terminals inside the housing. A fuse element, as defined here, could theoretically function, under proper conditions, as a current-vaporizable circuit interrupting fuse without a surrounding housing or fuse body.

A fuse having a fuse element consisting of a single piece stamping of a strip of fuse metal enclosed in a plastic housing is disclosed in the U.S. Pat. No. 3,909,767 to Williamson, et al. A three-piece fuse element in which a fusible link is soldered to two blades within a plastic housing is disclosed in the U.S. Pat. No. 3,775,724 to Mamrick, et al.

Fuses of the above-described types have met with significant commercial success and in general, have functioned satisfactorily for the intended purpose.

However, in spite of their apparent simplicity, fuses of the above-described types have a number of drawbacks.

One disadvantage of the above-described types of fuses is that the insulating enclosures or housings surrounding the fuse element (blades and connecting fusible link) are not in intimate contact with the fusible link and the junctions with the terminal blades. The housing may or may not be open at the end from which the terminal-forming blade ends protrude. In either case, the housing is spaced away from the fusible link and/or upper portions of the blades to which the link is connected. The insulating housing thus defines a volume or space around the fusible link and necessarily contains an atmosphere of some kind. Generally, the housing interior communicates with the ambient atmosphere outside of the housing. Even those housings which totally enclose the upper portions of the terminal-forming blades and the fusible link are commonly not leak-tight and do allow air to pass into the housings to help dissipate the heat generated by the fuse element. Thus, it is possible for foreign matter, especially dust, airborne corrosive particles, and other such airborne contaminants, to enter the insulating housing and be deposited on the fusible element. To the extent that such airborne contaminants may react with, corrode, or otherwise have a deleterious effect upon the fusible link and/or upper portion of the terminal-forming blades, the admission of such contaminants is undesirable.

Even where an insulating housing could be made completely airtight, extraordinary care would have to be taken during manufacture to carefully control the atmosphere within the sealed insulating housing. If such care were not taken during manufacture, contaminants could be sealed within the housing during manufacture. Presumably, this problem would be somewhat alleviated by forming the insulating housing around the fusible link in a vacuum or in some inert atmosphere. Obviously, such a structure would be more complicated and expensive to manufacture than a structure not manufactured in a vacuum or in an inert atmosphere.

For those types of fuses in use today in which the housing is open to atmopshere or is not airtight, the internal volume within the housing around the fusible link is thus going to contain an atmosphere which may then vary in pressure as well as composition (e.g., water vapor content and contaminants) according to the variations in the ambient atmosphere. Thus, thermal conductivity and heat capacity of the atmosphere within the housing will vary to the extent of their dependence upon the above-listed parameters. Since the atmosphere within the housing functions, to some extent, to dissipate heat generated by the fuse element, variations in the atmosphere could cause slight variations in the rate of dissipation of heat generation from the fuse element. In some cases, depending upon the size of the fuse, the type of fusible link material employed, the current rating of the fuse and the normal design current passing through the fuse, the actual current level at which the fuse may "blow" could vary from the intended design rating.

With those types of fuses in use today in which the housing is open to the atmosphere or is not airtight, there is the possibility that when the fuse blows, the arcing of the vaporizing fusible link can, because of the communication with the ambient atmosphere, ignite or explode combustible gases that may be present. This is especially important with respect to fuse applications in automotive vehicles, airplanes, ships and the like wherein during and/or after an accident or collision, one or more fuses may blow and where gasoline vapors or other fuel fumes may be present. Thus, it would be desirable to provide a totally encapsulated fuse wherein the arcing of the fusible link is entirely contained or submerged within a noncombustible material to prevent its communication with ambient atmosphere.

With those types of plug-in fuses having a fuse element stamped from a single piece of metal, there are other disadvantages. For example, the terminal-forming blade portions, as well as the fusible link, are necessarily formed from the same sheet of fusible metal. This presents certain problems. If it is desired to have a fusible link comprised of a very soft and low-melting alloy, the terminal-forming blades will be undesirably soft and ductile. Further, to the extent that a fusible link material is desired with a composition that is very carefully controlled and that is made from an expensive metal or metal alloy, the cost of the fuse is unnecessarily increased because the terminal-forming blade portions must also necessarily be composed of the more expensive material.

Typically, those types of plug-in fuses having fuse elements stamped from a single piece of metal use a zinc alloy for the fuse element. With such a one-piece element, both the fusible link and the terminal-forming blade portions of the fuse element are comprised of the zinc alloy. This has a serious drawback, however, because the plug-in fuse receiving housing commonly incorporated female pressure clip connectors which are made from brass. Owing to the galvanic cell created between the zinc alloy terminal-forming blades and the brass female pressure clip connectors, electrolytic corrosion can be a problem. Thus, it would be advantageous to provide a plug-in fuse wherein the terminal-forming blades are made of brass instead of zinc alloy. However, plug-in fuses having a fuse element stamped from a single piece of material are not easily made from brass owing to problems that brass presents in the stamping process. Fusible links typically have a relatively small cross section with a thickness measured in thousandths of an inch. It is very difficult to stamp the fusible link from brass to the proper dimensions within the necessary tolerances. Other metals, such as some zinc alloys, are much more suitable for the stamping process and can be stamped with a relatively small cross section within the necessary tolerances. Consequently, in order to take advantage of the strength and durability characteristics of brass, and in order to avoid electrolytic corrosion problems, it would be desirable to provide a plug-in fuse having brass blades but having a fusible link which can be formed from a different metal that is well-suited for the forming processes employed.

With those types of plug-in fuses having a fusible link separate from the terminal-forming blade portions, but secured thereto by soldering, the manufacture of the fuse requires the additional soldering step which adds to the cost of the fuse. Additionally, the soldered connections are susceptible to cracking, fracturing, weakening, and/or other kinds of degradation resulting from vibration and/or bending loads to which the fuse is subjected during normal use. Further, during the period when the fuse is carrying a normal current, or currents above the normal design level but below the amount required to cause the fuse to blow, the soldered connections may heat up sufficiently to become fluid and the connection may thereupon be destroyed.

SUMMARY OF THE INVENTION

The present invention provides an extremely simplified plug-in electrically conducting component structure and method of forming the same. The component can be easily and efficiently manufactured. In the preferred embodiment, the component functions as a fuse and has a separate fusible link or wire mounted across two blades. The fusible wire is completely encapsulated in an insulating material and is thus protected from undesirable atmospheric contamination. The blades have a unique spring clip structure which accommodates fusible wires of varying diameters and which forms a solderless clamp-type connection to the fuse wire that is self-aligning and vibration resistant.

Specifically, in the preferred fuse embodiment, a pair of terminal-forming blades are stamped from a suitable conducting material and are each provided on one end with a spring clip structure comprising a pair of spaced-apart rear bearing members and a flexibly hinged front bearing tongue between the rear bearing members. Each of the rear bearing members has a cradle with a substantially V-shaped cross section for receiving a portion of a conducting fuse wire. To provide rigidity and permit the pair of rear bearing members to be held as one piece during assembly of the fuse, the bearing members may be integrally connected together by a wall portion outwardly of their cradles. The terminal-forming blades are spaced apart in generally parallel relationship and the fusible wire is aligned substantially perpendicular to each blade and is inserted into the spring clip of each blade. The front bearing tongue is allowed to press against the fuse wire and hold it in a clamping engagement within the cradle of each rear bearing member to provide a solderless, electrically conducting path from one of the blades through the fusible link to the other of the blades. The fuse wire and the spring clip portion of each of the blades is preferably encapsulated with a solid unitary body of electrically insulated material such as a transparent thermoplastic, with the external surfaces of the fuse wire and blade spring clip portions in intimate contact with the encapsulating material.

The structure of the preferred embodiment of the present invention thus offers a number of advantages over the prior art described above in the "Background of the Invention". For example, the terminal-forming blades can be made of any suitable conducting material and the fuse wire can be made of another material. This allows the terminal-forming blades to be formed of a material that will provide appropriate strength and durability which will withstand the abuse of insertions into female pressure spring clip assemblies. Owing to the unique design of the spring clip structure itself, the same blade design can be used for a number of differently rated fuses wherein fuse wires of different diameters are required.

Since the fuse wire is not soldered to the spring clip structure of the blade, the possibility of a soldered joint being destroyed by vibration, bending loads, or current heating is eliminated. Further, encapsulation of the fuse wire and spring clip portions of the blades provides additional support for the fuse wire.

The encapsulating material, being in intimate contact with the surfaces of the fuse wire, functions as a heat sink and can be formed around the fuse wire in a generally cylindrical shape to provide a substantially symmetrical temperature gradient and consequent uniform heat transmission from the fuse wire through the encapsulating material. The fact that the temperature gradient can be made substantially uniform and the fact that the fuse wire is not exposed to ambient air makes it possible to design a fuse which will "blow" at the specified current rating independent of atmospheric conditions and with negligible variation from fuse to fuse.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
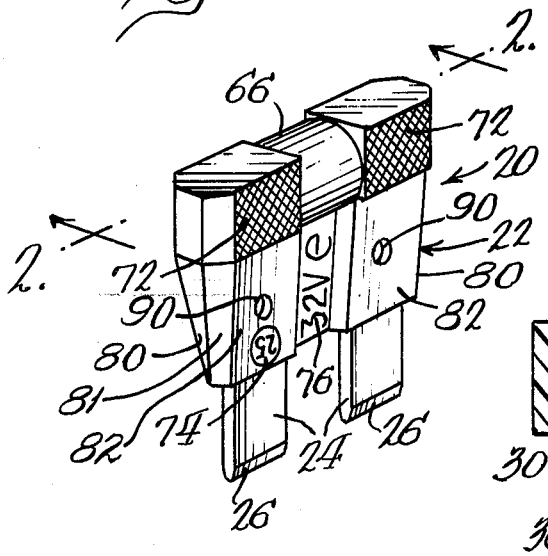
FIG. 1 is a perspective view of a fuse formed in accordance with the teachings of the present invention.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

For ease of description, the component of the present invention will be described with the terminal-forming blades oriented vertically and with the spring clip structure at the upper end of each blade. Terms sch as upper, lower, horizontal, etc., will be used with reference to this position. It will be understood, however, that the product of this invention may be manufactured, stored, transported and sold in orientation other than the position described.

Referring now to the drawings a plug-in electrically conducting component of the present invention is illustrated in a fuse shown in its entirety at 20 in FIG. 1, and includes a body 22 and a pair of terminals or terminal-forming blades or blades 24. Typically, the height of the fuse, from the top of the body 22 to the bottom end of the blades 24 is about ¾ inch. The width of the body 22 is about ¾ inch and the thickness of the body 22 is about 3/16 inch. The blades are typically 0.025 inch in thickness and may be spring brass or aluminum.

The blades 24 are seen to project from the bottom of the body 22 and have tapered or pointed end portions 26 which readily slip into place between the confronting walls of a conventional female spring clip support in a mounting panel or fuse block (not shown). The three-piece solderless plug-in fuse element which is encapsulated in, and supported by, the body 22 will first be described in detail. Subsequently, the body 22 will be more fully described.

Figure 2:
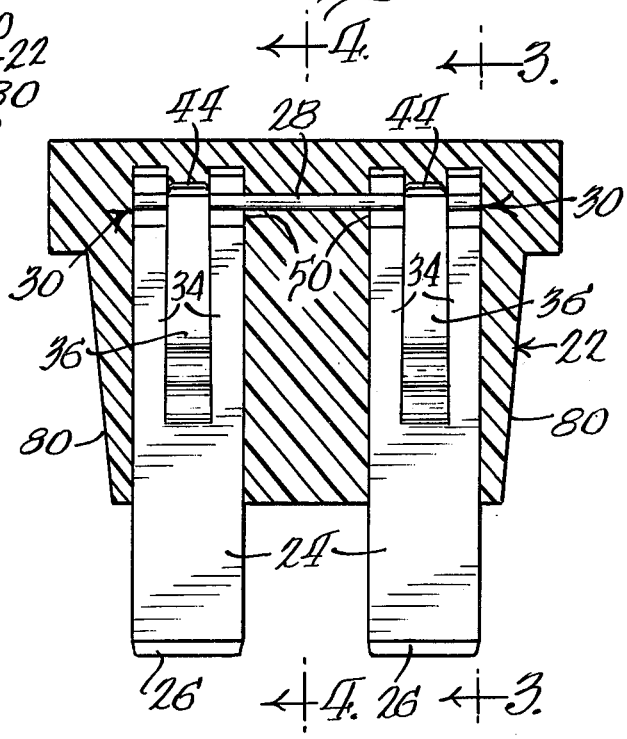
FIG. 2 is an enlarged cross-sectional view taken substantially along the plane 2—2 of FIG. 1.

With reference to FIG. 2, the three-piece fuse element is best illustrated as comprising the blades 24 and a fusible link, such as a substantially cylindrical fuse wire 28 connected between the pair of blades 24. Blades 24 are spaced apart in generally parallel relationship with the upper portions of the blades lying within the body 22. The fuse wire 28 is disposed substantially perpendicular to the blades 24 and a portion of the link 28 on each end is clamped by a novel spring clip structure 30 on the upper portion of each of the blades 24.

Figure 3:
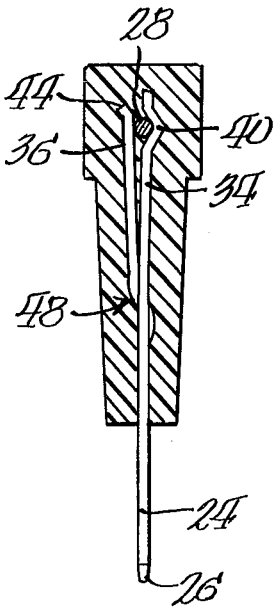
FIG. 3 is a cross-sectional view taken along the plane 3—3 of FIG. 2.
Figure 4:
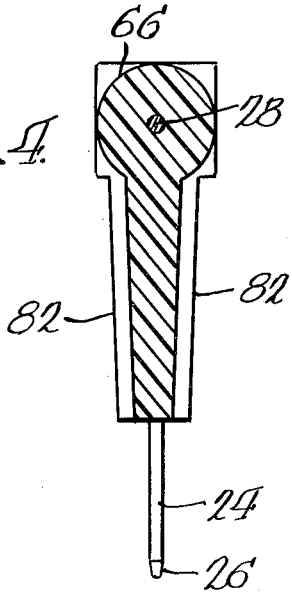
FIG. 4 is a cross-sectional view taken along the plane 4—4 of FIG. 2.
Figure 7:
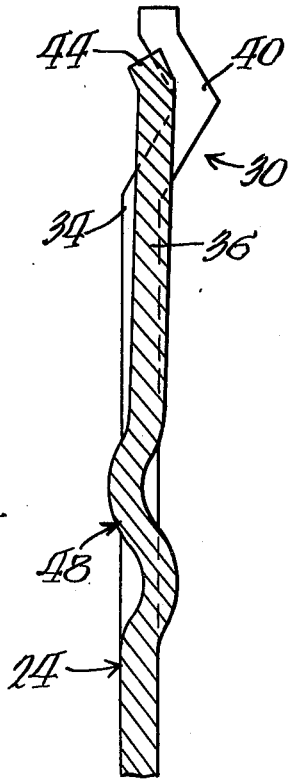
FIG. 7 is a cross-sectional view taken generally along the plane 7—7 of FIG. 6.
Figure 8:
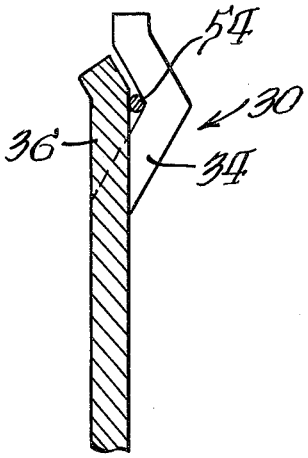
FIG. 8 is an enlarged fragmentary, cross-sectional view of the spring clip portion of the blade shown in FIG. 7 with a small fuse wire engaged therewith.
Figure 9:
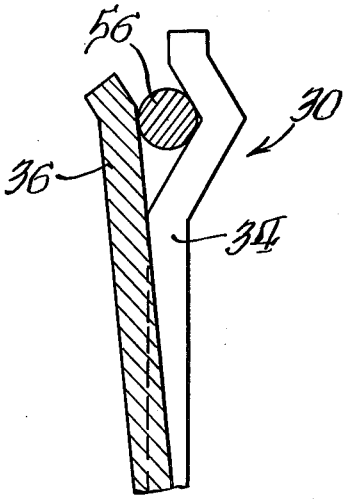
FIG. 9 is a fragmentary, cross-sectional view similar to FIG. 8 showing the spring clip portion of the terminal blade of FIG. 7 with a large fuse wire engaged therewith.

With reference to FIGS. 3, 6, 7, 8, and 9, the spring clip structure of each blade 24 is seen to comprise a pair of spaced-apart rear bearing members 34 and a flexibly hinged front bearing tongue 36 between the rear bearing members 34. One end of the tongue 36 is free to bend outwardly as illustrated in FIGS. 3, 8 and 9 and the other end of the tongue 36 is integrally connected with the blade 24 to form a flexible hinge as at 38 in FIG. 6.

Each of the two rear bearing members 34 of the pair of rear bearing members 34 has a cradle 40 with a substantially V-shaped cross section for receiving a portion of the fuse wire 28 as is best illustrated in FIG. 3. To allow the fuse wire 28 to be easily inserted between the rear bearing members 34 and the flexibly hinged front bearing tongue 36, the tip 44 of the free end of the front bearing tongue 36 is angled outwardly away from the rear bearing members 34.

Figure 5:
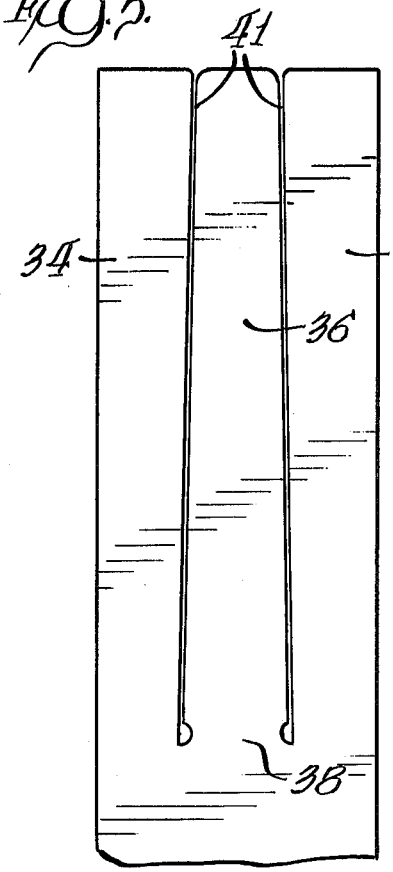
FIG. 5 is an enlarged fragmentary rear view of the spring clip portion of one terminal-forming blade after being blanked out but before being stamped into its final configuration.
Figure 6:
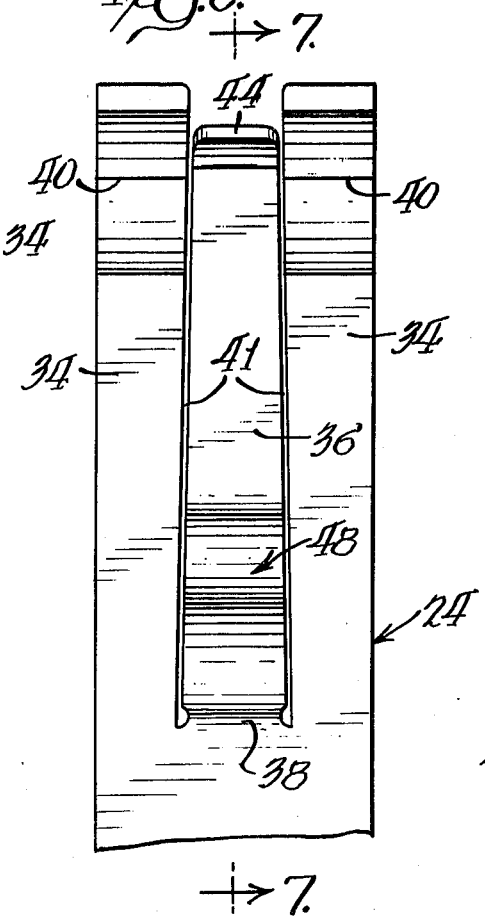
FIG. 6 is an enlarged fragmentary rear view like FIG. 5 but showing the spring clip portion of the terminal blade after having been stamped into its final configuration.

The spring clip structure, comprising the rear bearing members 34 and the front bearing tongue 36 of each blade 24, may be cut or blanked from a single sheet of material as illustrated in FIG. 5. In particular, the front bearing tongue 36 and the rear bearing members 34 are initially formed by providing cuts 41 on each blade 24. Following the blanking operation, the particular cradle configuration 40, the slanted tip 44 of the front bearing tongue 36 and the S-shaped portion 48 of the front bearing tongue 36 may be subsequently stamped in a separate operation. Alternatively, both the blanking and the forming of the blank into the final configuration may be performed in one step. If desired, the blade can be blanked as illustrated in FIG. 5 with the cuts 41 being slanted so that the width of the tongue decreases in width from a maximum at the flexible hinge 38 to a minimum at the free end or tip 44.

The flexing action of the front bearing tongue 36 may be controlled to some extent by the shape of the bottom portion of the tongue at its points of connection to the main part of the blade 24. Specifically, as illustrated in FIGS. 3 and 7, the front bearing tongue may have a generally S-shaped cross section in a portion of its length as at 48.

The front bearing tongue 36 is formed into an S-shaped cross section to reduce its overall length with respect to its extension from the flexible hinge 38. That is, the front bearing tongue 36 is drawn downwardly towards the flexible hinge 38 so that the tongue becomes located between the increased width region between the two rear bearing members 34, which increased width region is defined by the slanted or tapering cuts 41. This provides more freedom of movement of the tongue by reducing frictional interference between the tongue and rear bearing members.

The unique spring clip structure 30 described above offers a number of advantages. First, solder is not required to secure the fuse wire 28 to the blades 24. Second, the unique cradle structure 40 of each blade 24, in cooperation with the front bearing tongue 36, provides a self-aligning, clamping, engagement which is resistant to failure under vibration loading. In fact, to some extent, vibration of the assembly of the fuse wire blades would tend to promote proper centering of the fuse wire within the apex of the V-shaped cradles 40. That is, if for some reason during manufacture, the fuse wire 28 was displaced from the apex of the "V" and was improperly positioned on one or the other of the two legs of the "V" of the cradle 40, then any vibration would tend to cause the fuse wire 28 to slide along the leg of the "V" to the apex of the "V" wherein the wire 28 would be seated under influence of the oppposing pressure of the front bearing tongue 36 in a self-aligning, clamping engagement.

Since solder is not required to make the joint or connection between the fuse wire 28 and the spring clip structure 30 of each blade 24, the clamping engagement effected by the spring clip structure 30 will not be deleteriously affected by heat generated in the fuse wire 28 under normal current carrying conditions or at currents approaching the current rating of the fuse. Although the spring clip structure 30 of a blade 38 may be heated up somewhat, the temperature increase would not be enough to affect the stiffness of the spring clip structure significantly, and would certainly not be enough to destroy the effectiveness of the spring clip clamping action. Obviously, at some very high temperature, the tongue 36 would lose some or all of its elastic, or spring, properties. However, this temperature is much higher than the melting point of the fuse wire 28, and thus that condition could not occur.

The unique spring clip structure 30 of the present invention allows fuses to be constructed with precise ratings. As can be seen best in FIG. 2, the fuse wire 28 is in contact with each blade 24 at the inside edge 50 of each blade 24. It is the precise spacing between these two electrical contact points which determines the rating of the fuse for any given wire 28. The spacing between the two side edges 50 of a pair of blades 24 in a given fuse can be precisely controlled during fabrication so that the fuse rating can be precisely determined. This is in contrast to solder-type connections where the mass of deposited solder is irregular and where the actual distance along the fuse wire between the two soldered blade connections cannot be easily predetermined or controlled during fabrication.

Various alloy compositions may be used for the fuse wire 28, depending upon the rating of the fuse. Typically, 95/5 tin lead wire is used. This is fairly soft and may bend slightly under the influence of the spring force of the front bearing tongue 36 pressing the wire 28 against the two V-shaped cradles 40 in each terminal blade 24 on either side of the tongue. By appropriate design, the spring force of the tongue is not high enough to cause the tongue 36 or the V-shaped cradle portions 40 of the terminal blade 24 to cut into the soft fuse wire 28. However, any slight "bending" of the fuse wire between the pair of cradles 40 of a blade 24 does effect an even more secure clamping engagement and is, for that reason, desirable.

For a given fuse wire composition, the diameter of the wire may be varied to obtain differing fuse ratings. As illustrated in FIGS. 8 and 9, the unique spring clip structure 30 of the present invention will, for a given size spring clip, accommodate fuse wires of varying diameter. In FIG. 8, a relatively small fuse wire 54 is shown clamped between the front bearing tongue 36 and the rear bearing member 34 and in FIG. 9, a relatively large diameter fuse wire 56 is shown clamped between the front bearing tongue 36 and a rear bearing member 34. Thus, it is possible that a single blade may be used in a large number of differently rated fuses. This of course promotes a certain economy of manufacture.

The novel spring clip structure of the present invention can easily accommodate, and is typically designed to accommodate, fuse wires having a diameter on the order of between 0.010 inches and 0.040 inches. The spring clip structure will typically permit the front bearing member to bend outwardly away from its normal vertical position in alignment with the rear bearing members a distance of about 0.052 inches to accommodate insertion of the 0.040 inch diameter fuse wire. Typically, the blades are made from spring brass which has been found to have the suitable spring characteristics.

The first embodiment described above has been illustrated with generally rectangular, male, terminal-forming blades. The present invention contemplates that the blades be received within an electrical component receiving block having within it pairs of spaced-apart, spring-biased, conducting strips forming female connectors for matingly engaging the blades of the electrical component. It is to be understood, however, that each of the blades of the electrically conducting component of the present invention may have a terminal-forming portion comprising a pair of spaced-apart, spring-biased, conducting elements or strips forming a female structure which could be connected with a male conducting structure mounted in a suitable receiving block.

Figure 10:
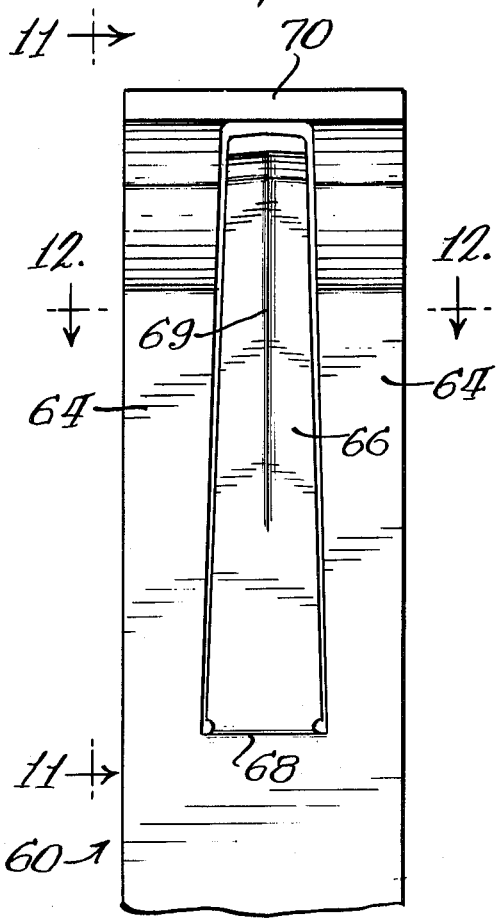
FIG. 10 is an enlarged, fragmentary view like FIG. 6, but showing another embodiment of the spring clip portion of the terminal blade.
Figure 11:
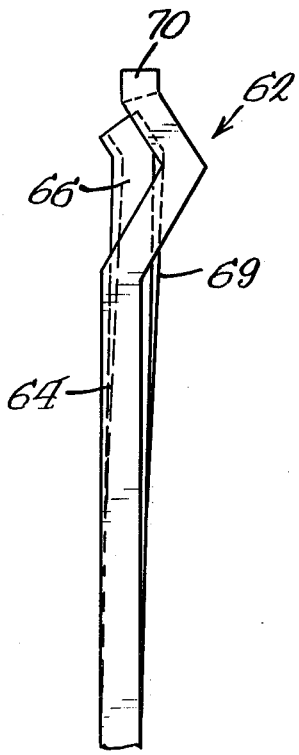
FIG. 11 is a cross-sectional view taken generally along the plane 11—11 of FIG. 10.
Figure 12:
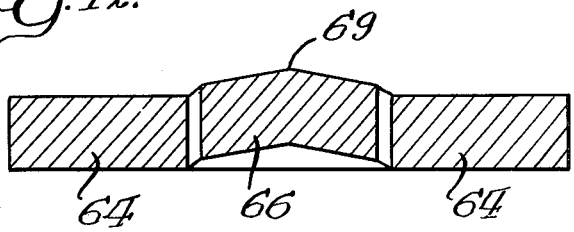
FIG. 12 is a cross-sectional view taken generally along plane 12—12 of FIG. 10.

Another embodiment of a blade 60 incorporating a unique spring clip structure 62 of the present invention is illustrated in FIGS. 10, 11 and 12. As in the first embodiment discussed above and illustrated in FIGS. 1 through 9, the second embodiment illustrated in FIGS. 10, 11 and 12 has a pair of rear bearing members 64 and a front bearing tongue 66 flexibly hinged between the rear bearing members 64. One end of the tongue 66 is free to bend outwardly as illustrated in FIG. 10 and the other end of the tongue is connected with the blade 60 by a flexible hinge 68.

The tongue 66 may be angled or bent, as at bend line 69, to provide more clearance between the rear bearing members 64 on either side of the tongue. The greater clearance effected by the novel bend configuration of tongue 66 is useful in accommodating any metal that may be displaced outwardly from the tongue during the stamping or blanking operation. The bend preferably extends about two-thirds of the length of the tongue.

This bend configuration may also be incorporated in the first embodiment of the spring clip structure illustrated in FIGS. 1 through 9 and previously described.

In some instances, it may be preferable to provide a connecting, rigidifying member between the ends of the rear bearing members of each blade. To provide additional rigidity, and to better enable the rear bearing members to be held together at one time during insertion of a fuse wire between the rear bearing members 64 and the front bearing tongue 66, a connecting member or wall portion 70 is provided to interconnect the ends of the rear bearing members 64. The wall portion 70 may be a separate member secured on each end to the rear bearing member 64 or may be, as illustrated in FIGS. 10 and 11, integrally stamped from the blade 60 so as to be continuous with the rear bearing members 64. Such a rigidifying member 70 is desirable with a three-piece solderless component of the present invention where the component is embedded in a fuse body which is formed by high pressure injection molding of an insulating material. Without a rigidifying member 70, the rear bearing members 64 may, under the impingement action of the high pressure injection material, be bent or displaced from the desired orientation.

The three-piece electrically conducting solderless component of the present invention is easily constructed by first forming the pair of blades and arranging the blades in spaced-apart, generally parallel relationship. The conducting element, such as a fuse wire, is aligned substantially perpendicular to the blades and seated within the clip structure of the blades by applying oppositely directed forces to the free ends of the front bearing tongue and the rear bearing members on each blade to spread them apart sufficiently so that the fuse wire can be inserted therein. Once the forces on the tongue and rear bearing members have been released, the fuse wire is automatically gripped.

In some instances, for example when using the electrically conducting three-piece solderless component of the present invention as a fuse, an encapsulating body may be provided around the conducting element and a major portion of the blades. With respect to FIGS. 1 through 4, a fuse 20 has an encapsulating body 22 which is preferably a solid, unitary body of electrically insulating material, such as a thermoplastic, and which is in intimate contact with the external surfaces of the fuse wire 28 and the spring clip portions 30 of each blade 24. As is best illustrated in FIGS. 2 and 3, the body 22 extends over more than half the length of each blade 24.

The encapsulating body provides a gripping or supporting function with respect to the unique clip structure of the present invention. If the insulating material is a molded thermoplastic, owing to shrinking during cooling after the molding process, the thermoplastic material provides very good support for the spring clip structure.

The body 22 may have a specific configuration required to fit within a fuse block. For example, the unitary body 22 may have two pairs of lower walls, such as end walls 80, slanting corner walls 81, and slanting side walls 82. The slanting walls slope inwardly towards the terminal portions of the blades 24 and may be wedged between walls (not shown) of a plug-in fuse block to hold the fuse therein.

Above the walls 82, the body 22 preferably has a cylindrical structure 66 as best illustrated in FIGS. 1 and 2. The cylindrical structure 66 is generally centrally located with respect to the length of the fuse so that the fuse wire 28 is substantially centered within the cylindrical structure 66. Centering of the fuse wire 28 within the cylindrical structure 66 effects a substantially symmetrical temperature gradient and consequent uniform heat transmission from the center segment of the fuse wire 28 through the cylindrical structure 66 to the surface of the fuse and then into the ambient atmosphere.

The body 22 is preferably made of a clear thermoplastic which can be easily molded about the three-piece fuse wire and blade assembly and which, owing to its transparency, effects an optical magnification of the fuse wire 28 through the generally cylindrical structure 66.

A number of different thermoplastic materials may be used for the body 22. For fuses of relatively low amperage capacity, a rubber-filled thermoplastic such as SAN may be used. For fuses having higher amperage capacities, a polycarbonate thermoplastic, such as LEXAN, may be used. For fuses will still higher amperage ratings, a thermoplastic that is more resistant to high temperatures, such as the high-temperature type of nylon, may be used.

Though it is preferable that the cylindrical portion 66 be made of a transparent thermoplastic to allow visual examination of the condition of the fuse wire 28 therein, it may also be desirable to add a pigment, surface coating or frosting to the remaining exterior portions, or parts of the remaining exterior portions, of the body 22. Further, apertures such as at 90, may be provided in one or more of the side surfaces 62 to allow insertion of a conventional electrical test probe (not shown) for contacting the blades 24 of th fuse to test the continuity of the fuse while it is plugged into a fuse block.

As illustrated in FIG. 1, a roughened or knurled gripping surface 72 may be provided on the upper exterior portions of the body 22 to permit one to better grip the fuse during insertion into, or removal from, a fuse receiving block. Preferably, the knurled surfaces 72 are located on either side of the generally cylindrical magnification structure 66. Additionally, various indicia such as at 74 and 76 may be provided on various exterior portions of the body 22 to indicate the electrical ratings, manufacturer's insignia and the like.

The use of a totally encapsulated body of insulating material surrounding the fuse element in accordance with the present invention serves to contain the electrical arc generated when the fuse blows. Since the arc is not then in communication with the ambient temperature, it is impossible for the fuse, upon blowing, to ignite any combustible vapors which may be in the ambient atmosphere. Thus, a fuse structure in accordance with the present invention provides a fuse which is essentially non-explosive and therefore desirable for use in automobiles, airplanes, ships and the like, as well as in stationary industrial applications where explosive vapors are a problem.

From the foregoing, it will be observed that numerous variations and modifications may be effected without departing from the true spirit and scope of the novel concept of the invention. It is to be understood that no limitation with respect to the specific apparatus illustrated herein is intended or should be infrared. It is, of course, intended to cover by the appended claims all such modifications as fall within the scope of the claims.

What is claimed is:

1. An encapsulated, three-piece solderless plug-in fuse comprising:

a pair of spaced-apart, generally parallel blades, each blade having at one end a terminal portion for being connected in an electrical circuit and at the other end a fusible link support spring clip;

a fusible link disposed substantially perpendicular to each blade and clamped at one end by the spring clip of one of said pair of blades and at the other end by the spring clip of the other of said pair of blades; and a solid unitary body of electrically insulating material encapsulating said fusible link and the fusible link support spring clip of each of said blades, the external surfaces of said link and said blade spring clip portions being in intimate contact with said material.

2. An encapsulated, three-piece solderless plug-in fuse in accordance with claim 1 in which said unitary body has two pairs of walls, one pair being perpendicular to the other pair and one of the pairs of walls slanting inwardly towards the terminal portions of said blades whereby the slanting walls may be wedged between the end walls of a plug-in fuse block to hold the fuse therein.

3. An encapsulated, three-piece solderless plug-in fuse in accordance with claim 1 in which said encapsulating material is a substantially transparent thermoplastic material.

4. An encapsulated, three-piece solderless plug-in fuse in accordance with claim 3 in which a portion of said unitary body around a center segment of said fusible link has a cylindrical surface for effecting optical magnification of said link and for providing a substantially symmetrical temperature gradient and consequent uniform heat transmission from the center segment of said fusible link through said body.

5. A three-piece solderless plug-in fuse element comprising:

a pair of spaced-apart, generally parallel blades, each blade having at one end a terminal portion for being connected into an electrical circuit and at the other end a fusible link support spring clip; and a fusible link disposed substantially perpendicular to each blade and releasably clamped at one end by the spring clip of one of said pair of blades and at the other end by the spring clip of the other of said pair of blades to provide a solderless electrically conductive path from one of said blades through the fusible link to the terminal portion of the other of said blades.

6. The plug-in fuse element in accordance with claim 5 in which both of said blades are substantially rectangular and coplanar.

7. The plug-in fuse element in accordance with claim 5 in which said fusible link comprises a substantially solid cylindrical wire.

8. A three-piece solderless, plug-in fuse element comprising:

two spaced-apart, generally parallel, substantially rectangular, coplanar blades and a fusible link clamped at each end to one of said blades, each blade having at one end a terminal portion for being connected into an electrical circuit and having at the other end (a) a pair of spaced-apart rear bearing members and (b) a flexibly hinged front bearing tongue between said rear bearing members, a segment at each end of said fusible link being clamped between said front bearing tongue and said pair of rear bearing members to provide a solderless electrically conductive path from one of said blades through the fusible link to the terminal portion of the other of said blades.

9. The plug-in fuse element in accordance with claim 8 in which said fusible link is a substantially cylindrical wire.

10. The plug-in fuse element in accordance with claim 9 in which each of said rear bearing members has a cradle with a substantially V-shaped cross section for receiving a portion of said fusible link end segment in self-aligning, vibration resistant, clamping engagement and for accommodating fusible link wires of varying diameter.

11. The plug-in fuse element in accordance with claim 9 in which the rear bearing members are integrally connected by a rigidifying member outwardly of their cradles.

12. The plug-in fuse element in accordance with claim 9 in which said front bearing tongue has a generally S-shaped cross section in a portion of its length.

13. The plug-in fuse element in accordance with claim 9 in which said pair of rear bearing members and said front bearing tongue of each blade are stamped from a single piece of metal.

14. The plug-in fuse element in accordance with claim 13 in which said tongue decreases in width towards the free end.

15. An encapsulated three-piece solderless plug-in electrically conducting component comprising:

an elongate conducting element and at least two blades secured at spaced locations to said conducting element, each said blade having at one end a terminal portion for being connected into an electrical circuit and at the other end a conducting element support spring clip; and a solid unitary body of electrically insulating material encapsulating said conducting element and the conducting element support spring clip portion of each of said blades, the external surfaces of said element and said blade spring clip portions being in intimate contact with said material.

16. The component in accordance with claim 15 in which each said conducting element spring clip comprises:

(a) a pair of spaced-apart rear bearing members and (b) a flexibly hinged front bearing tongue between said rear bearing members, a segment at each end of said conducting element being clamped between said front bearing tongue and said pair of rear bearing members to provide a solderless electrically conductive path from one of said blades through the conducting element to the terminal portion of the other of said blades.

17. The component in accordance with claim 16 in which said elongate conducting element is a substantially cylindrical wire.

18. The component in accordance with claim 17 in which each of said rear bearing members has a cradle with a substantially V-shaped cross section for receiving a portion of said conducting element wire in self-aligning, vibration resistant, clamping engagement and for accommodating conducting element wires of varying diameter.

19. The plug-in fuse element in accordance with claim 18 in which said rear bearing members are integrally connected by a rigidifying member outwardly of their cradles.

20. The component in accordance with claim 17 in which said front bearing tongue has a generally S-shaped cross section in a portion of its length.

21. The component in accordance with claim 17 in which said pair of rear bearing members and said front bearing tongue of each blade are stamped from a single piece of metal.

22. The component element in accordance with claim 21 in which said tongue decreases in width towards the free end.

23. An encapsulated, three-piece solderless plug-in fuse comprising:

a pair of spaced-apart, generally parallel metal blades, a substantially cylindrical fuse wire disposed substantially perpendicular to, and connected with, each blade, each blade having at one end a terminal portion for being connected into an electrical circuit and at the other end a pair of spaced-apart rear bearing members and a flexibly hinged front bearing tongue between said rear bearing members, said bearing members and tongue being stamped from a single piece of metal with the width of the tongue decreasing towards the free end, each of said rear bearing members having a cradle with a substantially V-shaped cross section for receiving a portion of said fuse wire in self-aligning, vibration resistant, clamping engagement between said front bearing tongue and said pair of rear bearing members to provide a solderless electrically conductive path from one of said blades through the fuse wire to the terminal portion of the other of said blades; and a solid unitary body of electrically insulating transparent thermoplastic material encapsulating said fuse wire and a portion of each of said blades, the external surfaces of said wire and said bearing members and bearing tongue being in intimate contact with said material.

24. The fuse in accordance with claim 23 in which said fuse wire is constituted from one of the following alloys: (a) 95 percent tin and 5 percent lead, (b) 96 percent tin and 4 percent silver, (c) tin and antimony.

25. The fuse in accordance with claim 23 in which said terminal blades are one of spring brass and aluminum.

26. The fuse in accordance with claim 23 in which said thermoplastic material is one of styrene-acrylonitride, polycarbonate, and high temperature nylon.

27. The fuse in accordance with claim 23 in which said rear bearing members are integrally connected by a rigidifying member outwardly of their cradles.

28. The fuse in accordance with claim 23 in which said front bearing tongue has a generally S-shaped cross section in a portion of its length.

29. The fuse in accordance with claim 23 in which said unitary body has two pairs of lower walls, at least one of the pairs of walls slanting inwardly towards the terminal portions of said blades whereby the slanting walls may be wedged between the end walls of a plug-in fuse block to hold the fuse therein.

30. The fuse in accordance with claim 29 in which said body encapsulates each of said blades for at least half of the length of each blade.

31. The fuse in accordance with claim 29 in which the two pairs of lower walls have frosted exterior surfaces.

32. The fuse in accordance with claim 23 in which a portion of said unitary body around a center segment of said fuse wire has a cylindrical surface for effecting optical magnification of said wire and for providing a substantially symmetrical temperature gradient and consequent uniform heat transmission from the center segment of said fuse wire through said body.

33. The fuse in accordance with claim 23 in which said blades are generally rectangular.

* * * * *

UNITED STATES PATENT AND TRADEMARK OFFICE

CERTIFICATE OF CORRECTION

PATENT NO. : 4,164,725

DATED : August 14, 1979

INVENTOR(S) : Gerald L. Wiebe

It is certified that error appears in the above-identified patent and that said Letters Patent are hereby corrected as shown below:

Column 3, line 31, "incorporated" should be --incorporates--;

Column 5, line 63, "sch" should be --such--;

Column 6, line 67, "points" should be --point--;

Column 7, line 41, "blade 38" should be --blade 28--;

Column 10, line 31, "surfaces 62" should be --surfaces 82--;

Column 10, line 33, "of th" should be --of the--;

Column 10, line 49, "temperature" should be --atmosphere--;

Column 10, line 63, "infrared" should be --inferred--;

Column 12, line 14, "the" should be --said--.

Signed and Sealed this

*Twenty-fifth* Day of *December 1979*

[SEAL]

*Attest:*

SIDNEY A. DIAMOND

*Attesting Officer*

*Commissioner of Patents and Trademarks*